US007214204B2

(12) United States Patent
Nan

(10) Patent No.: US 7,214,204 B2
(45) Date of Patent: May 8, 2007

(54) VIBRATING MASSAGER WITH VISUAL COMMUNICATION MEANS

(75) Inventor: Simon Siu Man Nan, Ontario (CA)

(73) Assignee: Nanma Manufacturing Co. Ltd., Chai Wan (HK)

( * ) Notice: Subject to any disclaimer, the term of this patent is extended or adjusted under 35 U.S.C. 154(b) by 30 days.

(21) Appl. No.: 11/014,383

(22) Filed: Dec. 16, 2004

(65) Prior Publication Data

US 2006/0135892 A1 Jun. 22, 2006

(51) Int. Cl.
*A61H 1/00* (2006.01)

(52) U.S. Cl. ..... 601/46; 601/70

(58) Field of Classification Search ..... 601/46, 601/56, 57, 67–72, 76–84, 89, 93, 97, 101; 128/842, 856

See application file for complete search history.

(56) References Cited

U.S. PATENT DOCUMENTS

| | | | | |
|---|---|---|---|---|
| 4,191,179 | A | 3/1980 | Mattila | |
| 5,108,189 | A | 4/1992 | Oswald | |
| 5,125,751 | A | 6/1992 | Coigley | |
| 5,143,056 | A | 9/1992 | Yih-Jong | |
| 5,484,391 | A | 1/1996 | Buckman, Jr. et al. | |
| 5,577,996 | A | 11/1996 | Gardner et al. | |
| 5,582,580 | A | 12/1996 | Buckman, Jr. et al. | |
| 5,637,065 | A | 6/1997 | Chang | |
| 5,669,148 | A * | 9/1997 | McDermott | 33/355 R |
| 5,673,455 | A | 10/1997 | Per-Lee et al. | |
| 5,728,051 | A | 3/1998 | Chi | |
| 5,795,632 | A * | 8/1998 | Buchalter | 428/35.2 |
| 6,280,403 | B1 * | 8/2001 | Lok | 601/70 |
| 6,363,662 | B1 | 4/2002 | Coates | |
| 6,632,185 | B2 | 10/2003 | Chen | |
| 6,699,259 | B2 | 3/2004 | Fogarty et al. | |
| 6,764,456 | B1 | 7/2004 | Doherty | |
| 2004/0069317 | A1 * | 4/2004 | Kemp et al. | 132/311 |
| 2004/0229645 | A1 * | 11/2004 | Montgomery | 455/556.1 |

* cited by examiner

*Primary Examiner*—Michael A. Brown
(74) *Attorney, Agent, or Firm*—Peter S. Gilster; Greensfelder, Hemker & Gale, P.C.

(57) ABSTRACT

A multi-layer vibrating massager having a visual communication means for viewing an indicia disposed therein that does not interfere with the massaging function of the massager during operation is disclosed. The vibrating massager comprises a vibratory component encased by an transparent outer casing engaged to an end cap that permits the user to view the indicia through the outer casing. The indicia may be affixed to the vibratory component, disposed between the vibratory component and the outer casing, or affixed to the interior surface of the outer casing. In the preferred embodiment, the transparent outer casing is removable to enable the user to easily access and modify the indicia.

23 Claims, 3 Drawing Sheets

VIBRATING MASSAGER WITH VISUAL COMMUNICATION MEANS

FIELD OF THE INVENTION

The present invention relates to a vibrating massager, and more particularly to a vibrating massager having a multi-layer structure.

BACKGROUND OF THE INVENTION

Vibrating massagers for recreational and therapeutic use are well known in the art. A prior art vibrating massager may comprise a rigid body having a distal portion in communication with a proximal portion. The distal portion may include a vibrating head containing a vibratory component driven by a motor powered by batteries stored inside the proximal portion of the massager. However, it may often be desirable to provide an aesthetically attractive appearance to the vibrating massager by affixing indicia, such as decals, stickers or pictures, to the vibrating massager in order to provide an outwardly aesthetic attractiveness to the massager. Unfortunately, affixing such indicia to the vibrating massager may adversely affect the massaging function because direct contact with the indicia might provide an uncomfortable feeling to the user. In addition, the exposed indicia can degrade over time due to the direct contact of the indicia with various surfaces, fluids or abrasives.

Therefore, there is a need in the art for a vibrating massager having a visual communication means that permits viewing of indicia without adversely affecting the massaging function of the massager. There is a further need in the art for a vibrating massager that protects the indicia while permitting the indicia to be viewed by the user.

OBJECTS AND BACKGROUND OF THE INVENTION

A primary object of the present invention is to provide a vibrating massager having a visual communication means that permits viewing of indicia inside the massager.

Another object of the present invention is to provide a vibrating massager having a visual communication means that does not adversely affect the massaging function of the massager.

A further object of the present invention is to provide a vibrating massager having a transparent outer casing that permits viewing of indicia through the casing.

Yet another object of the present invention is to provide a vibrating massager having an aesthetic attractiveness that does not interfere with the massaging function of the massager.

Another further object of the present invention is to provide a vibrating massager that permits the user to customize the aesthetic appearance of the massager.

Yet another further object of the present invention is to provide a vibrating massager with a multi-layer structure that is easily accessible to the user.

Another object of the present invention is to provide a vibrating massager having at least two layers with an outside transparent layer encasing indicia interposed between the outside layer and an inside layer.

The present invention comprises a vibrating massager comprising a transparent outer casing, an end cap adapted to engage the transparent outer casing, a vibratory component encased inside the transparent outer casing, and indicia disposed inside the transparent outer casing, wherein the indicia is viewable through the transparent outer casing.

In another embodiment, the present invention comprises a multi-layer vibrating massager comprising an inner layer, an outside layer encasing said inner layer and engageable to an end portion, and an indicia interposed between the inner layer and outside layer, wherein the outside layer is sufficiently transparent to permit viewing of the indicia therein.

In still another embodiment, the present invention comprises a method of changing the aesthetic attractiveness of a vibrating massager comprising: providing a transparent outer casing, an end cap engageable to said transparent outer casing, a vibratory component encased inside the transparent outer casing, and providing an indicia disposed inside the outer casing; rotating the end cap until the outer casing disengages from the end cap; modifying the indicia disposed inside the transparent outer casing; and rotating the end cap until the transparent outer casing engages the end cap.

Additional objects, advantages and novel features of the invention will be set forth in the description which follows, and will become apparent to those skilled in the art upon examination of the following more detailed description of the drawings in which like elements of the invention are similarly numbered throughout.

DETAILED DESCRIPTION OF THE INVENTION

Figure 1:
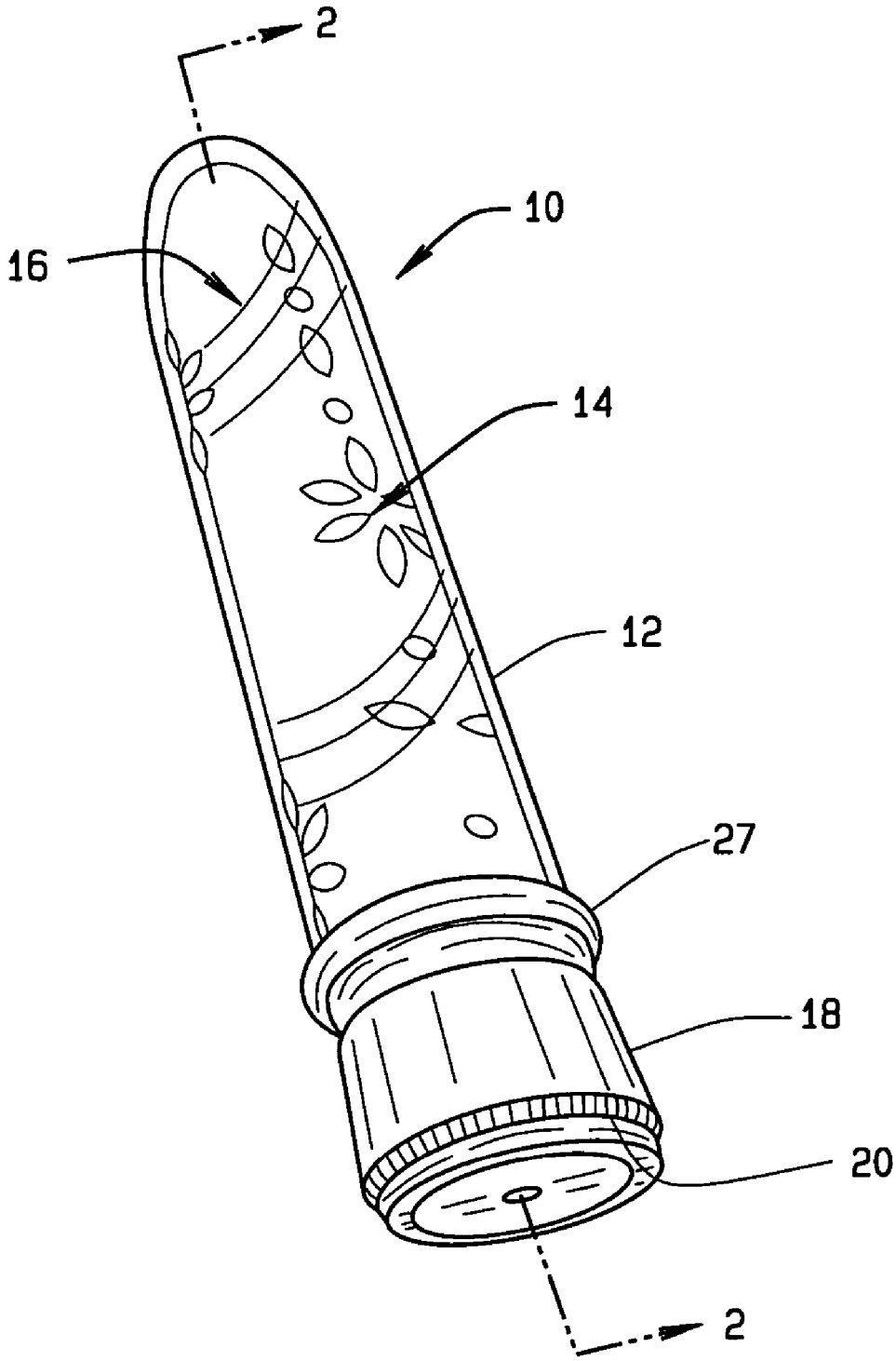
FIG. 1 is a perspective view of the vibrating massager according to the present invention.
Figure 2:
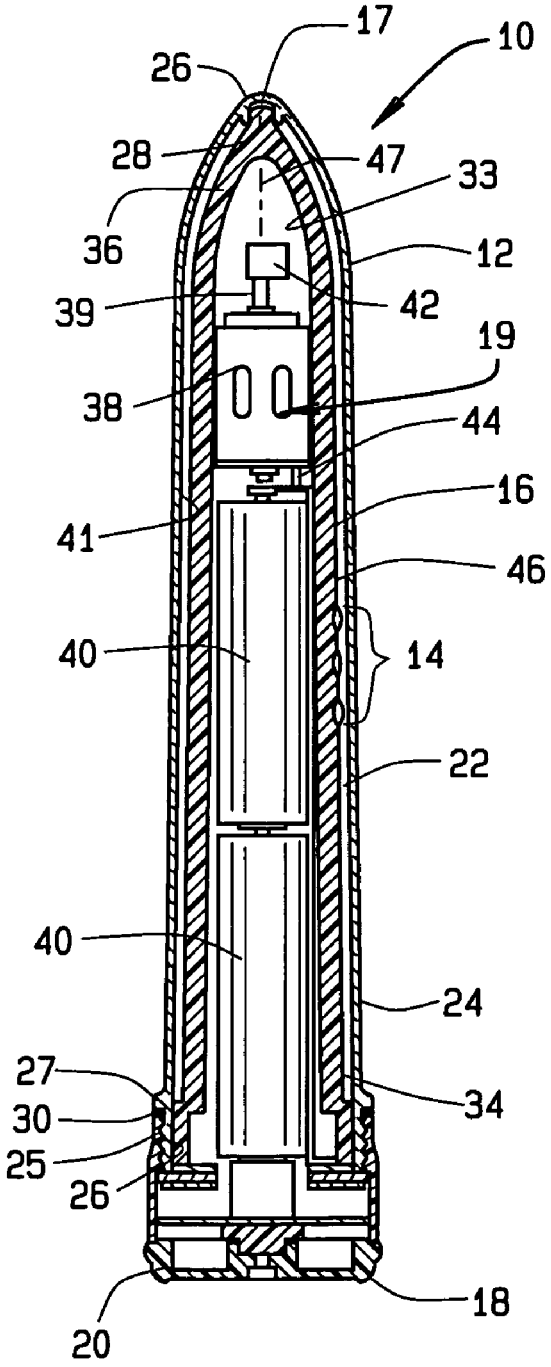
FIG. 2 is a partial cross sectional view of the vibrating massager taken along line 2—2 of FIG. 1 according to the present invention.
Figure 3:
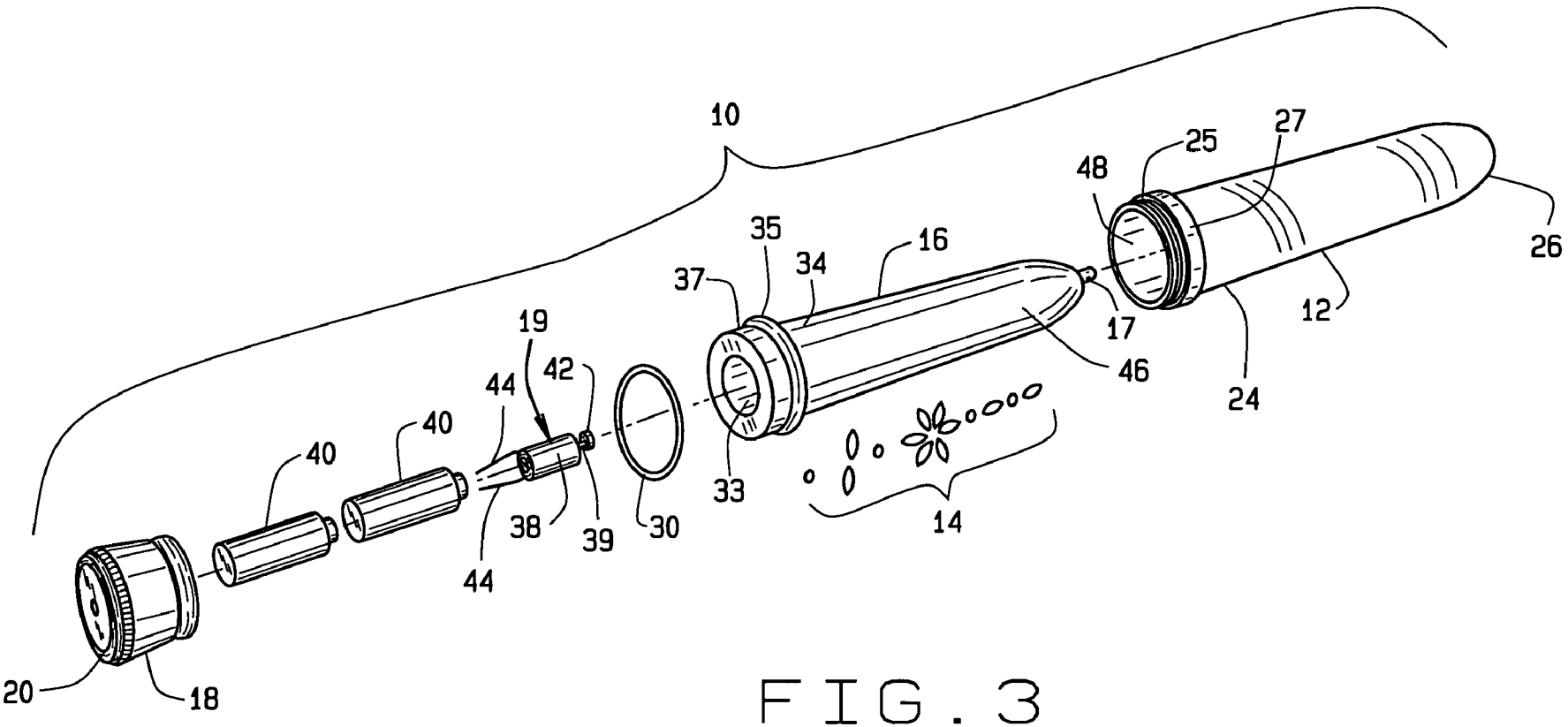
FIG. 3 is an exploded view of the vibrating massager according to the present invention.

Referring to the drawings, a preferred embodiment of a vibrating massager according to the present invention is illustrated and generally indicated as 10 in FIGS. 1–3. The vibrating massager 10 provides a visual communication means for viewing an indicia 14 disposed inside massager 10. As shown, vibrating massager 10 comprises a transparent outer casing 12 attached to a removable end cap 18 that encases an internal vibratory component 16.

Preferably, outer casing 12 is made of a transparent plastic material that encases the vibratory component 16 and permits the user to view component 16 when the vibrating massager 10 is assembled. Referring to FIG. 2, the vibratory component 16 provides a means for vibrating the vibrating massager 10 and defines a chamber 33 that houses a vibratory element 19 that is in operative association with one or more batteries 40 for providing power to vibratory element 19. As shown, the vibratory component 16 includes a flange 35 with a proximal portion 37 defined adjacent the flange 35 for engaging end cap 18 during assembly of vibrating massager 10. End cap 18 includes a rotatable dial 20 that controls the operation of vibratory element 19.

Referring to FIG. 3, vibratory element 19 includes a motor 38 operatively engaged to a rod 39 rotatably coupled to an eccentric mass 42 that spins about an axis 47 during operation. In operation, power is provided to motor 38 that rotates rod 39 which spins eccentric mass 42 about an axis 47 in a manner that causes the vibratory component 16 to vibrate. Preferably, vibratory component 16 includes an outer surface 46 which is visually communicated to the user through transparent outer casing 12.

As further shown, transparent outer casing 12 provides a visual communication means that enables the user to observe indicia 14 interposed between outer casing 12 and vibratory component 16 as shall be discussed in greater detail below. The outer casing 12 defines an interior surface 41 and further includes a closed tapered distal end 26 and an open proximal end 24 having a flange 27 defining an opening 48 that communicates with a chamber 22. As further shown, outer casing 12 includes exterior threads 25 located adjacent flange 27 to engage a corresponding set of interior threads 26 (FIG. 2) defined within end cap 18. In the preferred embodiment, outer casing 12 concentrically surrounds and encases vibratory component 16 when exterior threads 25 are engaged to the internal threads 26 by rotating outer casing 12 in a preferably clockwise motion relative to end cap 18 until flange 27 abuts end cap 18. In an alternative embodiment, outer casing 12 can be permanently affixed to vibratory component 16 to prevent the user from disassembling vibrating massager 10.

Figure 2A:
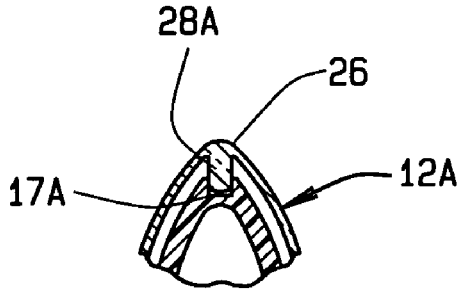
FIG. 2A is an enlarged cross sectional view of an alternative embodiment of the vibrating massager according to the present invention.

Referring to FIG. 2, transparent outer casing 12 defines a notch 28 along distal end 26. When engaging outer casing 12 to end cap 18, notch 28 is adapted to engage a tab 17 defined at the distal end of vibratory component 16 for providing a structural connection point and translating the vibratory motion imparted by vibratory component 16 to outer casing 12 during operation of vibrating massager 10. In an alternative embodiment shown in FIG. 2A, outer casing 12A includes a tab 28A adapted to engage a notch 17A defined along the distal tip of vibratory component 16 for translating the vibratory motion of vibratory component 16 to outer casing 12. Referring back to FIG. 3, a sealing member 30 is provided between flange 35 and end cap 18 to provide a water tight seal between outer casing 12 and end cap 18 during assembly of vibrating massager 10.

Referring back to FIG. 2, preferably a pair of batteries 40 are disposed within vibratory component 16 and are operatively engaged to motor 38 by an electrical wire 44. In operation, the user rotates dial 20 in one direction to place the vibrating massager 10 in the "on" position which completes an electrical circuit between batteries 40 and motor 38 that enables vibratory component 16 to vibrate. Once power is delivered to motor 38, rod 39 rotates about axis 47 which spins eccentric mass 42. This spinning action of eccentric mass 42 causes vibratory component 16 to vibrate at a predetermined rate. This vibratory motion is then transferred from vibratory element 16 to outer casing 12 through the structural connection point between the notch 28 and tab 17 discussed above.

When rotated to the "on" position, dial 20 has settings for two modes of operation enabling vibrating massager 10 to operate in a "low" speed mode or "high" speed mode by methods known in the art. Once dial 20 has been rotated to the "on" position at the desired speed mode, vibrating massager 10 vibrates at the selected speed of operation. Operation of the vibrating massager 10 may be terminated by rotating dial 20 in the opposite direction to the "off" position.

According to one aspect of the present invention, indicia 14 may be a single aesthetic element or a plurality of aesthetic elements that provide an overall aesthetic attractiveness to vibrating massager 10. As such, indicia 14 may be interposed between vibratory component 16 and outer casing 12 by either affixing indicia 14 to exterior surface 46 of vibratory component 16, disposing indicia 14 between vibratory component 16 and outer casing 12, or affixing indicia 14 to the interior surface 41 of outer casing 12 such that indicia 14 is viewed through the transparent outer casing 12.

Preferably, indicia 14 may be any kind of aesthetic element or elements, such as beads, jewelry, decals, stickers, magnets, pictures, photographs, drawings or other suitable aesthetic elements that provide a viewable aesthetic attractiveness to the vibrating massager 10. In the preferred embodiment, indicia 14 can be easily accessed when outer casing 12 is disengaged from end cap 18 by rotating end cap 18 in a clockwise motion. Once the outer casing 12 is disengaged, the user can remove, substitute or otherwise modify indicia 14 in any desired manner for customizing vibrating massager 10. Once indicia 14 has been so modified, outer casing 12 may be placed over vibratory component 16 and engaged to end cap 18 by preferably rotating outer casing 12 in a counter-clockwise direction as noted above.

It should be understood from the foregoing that, while particular embodiments of the invention have been illustrated and described, various modifications can be made thereto without departing from the spirit and scope of the invention as will be apparent to those skilled in the art. Such changes and modifications are within the scope and teaching of this invention as defined in the claims appended hereto.

What is claimed is:

1. A vibrating massager comprising:

a) a transparent outer casing;

b) an end cap adapted to engage said transparent outer casing;

c) a vibratory component encased inside said transparent outer casing; and d) an indicia disposed inside said transparent outer casing, wherein said indicia is viewable through said transparent outer casing, wherein e) the vibratory component is supported at opposite ends including a distal end of the vibratory component which is in contact with the outer casing by notch-and-tab securement for providing a structural connection point and translating the vibratory motion imparted by vibratory component to the outer casing during operation of vibrating massager.

2. The vibrating massager according to claim 1, wherein said indicia may be affixed to said vibratory component.

3. The vibrating massager according to claim 1 wherein said indicia may be disposed between said vibratory component and said outer casing.

4. The vibrating massager according to claim 1, wherein said outer casing comprises an interior surface.

5. The vibrating massager according to claim 4, wherein said indicia is affixed to said interior surface of said outer casing.

6. The vibrating massager according to claim 1, wherein said outer casing defines a notch and said vibratory component defines a tab for providing said structural connection point.

7. The vibrating massager according to claim 1 wherein said outer casing defines a tab and said vibratory component defines notch to provide said structural connection point.

8. The vibrating massager according to claim 1, wherein said indicia comprises a single aesthetic element.

9. The vibrating massager according to claim 1, wherein said indicia comprises a plurality of aesthetic elements.

10. The vibrating massager according to claim 1, wherein said end cap includes a rotatable dial that operates said vibratory component.

11. The vibrating massager according to claim 1, wherein said vibratory component comprises a motor rotatably engaged to a rod for spinning an eccentric mass.

12. A multi-layer vibrating massager comprising:

a) an inner layer;

b) an outside layer encasing said inner layer and engageable to an end portion;

c) an indicia interposed between said inner layer and said outside layer, wherein said outside layer is sufficiently transparent to permit viewing of said indicia therein; and d) a vibratory component providing the inner layer;

e) the vibratory component being supported at opposite ends, the vibratory component including a distal end component which is in contact with the outer layer securement for providing a structural connection point and translating the vibratory motion imparted by vibratory component to the outer layer during operation of vibrating massager.

13. The multi-layer vibrating massager according to claim 12, wherein said outside layer protects said indicia.

14. The multi-layer vibrating massager according to claim 12, wherein said indicia is affixed to said inner layer.

15. The multi-layer vibrating massager according to claim 12, wherein said indicia may be disposed between said inner layer and said outer layer.

16. The multi-layer vibrating massager according to claim 12, wherein said outer layer comprises an interior surface.

17. The multi-layer vibrating massager according to claim 16, wherein said indicia is affixed to said interior surface.

18. A method of changing the aesthetic attractiveness of a vibrating massager, said method comprising:

a) (1) providing a vibrating massager including a transparent outer casing, an end cap engageable to said transparent outer casing, a vibratory component adapted to engage said transparent outer casing, and an indicia disposed inside said outer casing; including (2) causing a distal end of the vibratory component vibratory component to be maintained in contact with the outer casing by notch-and-tab securement for providing a structural connection point and translating the vibratory motion imparted by vibratory component to the outer casing during operation of vibrating massager;

b) disengaging said end cap from said transparent outer casing;

c) modifying said indicia disposed inside said transparent outer casing; and d) engaging said end cap with said transparent outer casing.

19. The method according to claim 18, wherein said step of modifying said indicia further includes affixing said indicia to said vibratory component.

20. The method according to claim 18, wherein said step of modifying said indicia further includes interposing, said indicia between said vibratory component and said outer casing.

21. The method according to claim 18, wherein said step of modifying said indicia further including affixing said indicia to said outer casing.

22. The method according to claim 21, wherein said indicia is affixed to an interior surface of said Outer casing.

23. The method according to claim 18, wherein said step of disengaging and engaging of said end cap requires rotation of said end cap.

* * * * *